US011638114B2

(12) United States Patent
Januszkiewicz et al.

(10) Patent No.: US 11,638,114 B2
(45) Date of Patent: Apr. 25, 2023

(54) METHOD, SYSTEM AND COMPUTER PROGRAM PRODUCT FOR RECORDING AND INTERPOLATION OF AMBISONIC SOUND FIELDS

(71) Applicant: ZYLIA SPOLKA Z OGRANICZONA ODPOWIEDZIALNOSCIA, Poznan (PL)

(72) Inventors: Lukasz Januszkiewicz, Jastrowie (PL); Eduardo Patricio, Poznan (PL); Adam Kuklasinski, Poznan (PL); Andrzej Ruminski, Grebocin (PL); Tomasz Zernicki, Poznan (PL)

(73) Assignee: ZYLIA SPOLKA Z OGRANICZONA ODPOWIEDZIALNOSCIA, Poznan (PL)

( * ) Notice: Subject to any disclaimer, the term of this patent is extended or adjusted under 35 U.S.C. 154(b) by 0 days.

(21) Appl. No.: 17/288,860

(22) PCT Filed: Jan. 14, 2020

(86) PCT No.: PCT/IB2020/050265

§ 371 (c)(1),
(2) Date: Apr. 26, 2021

(87) PCT Pub. No.: WO2020/148650

PCT Pub. Date: Jul. 23, 2020

(65) Prior Publication Data

US 2022/0007128 A1 Jan. 6, 2022

(30) Foreign Application Priority Data

Jan. 14, 2019 (PL) ..... 428575

(51) Int. Cl.
*H04S 7/00* (2006.01)
*H04R 5/04* (2006.01)

(52) U.S. Cl.
CPC ..... *H04S 7/307* (2013.01); *H04R 5/04* (2013.01); *H04S 2420/11* (2013.01)

(58) Field of Classification Search
None
See application file for complete search history.

(56) References Cited

U.S. PATENT DOCUMENTS

2017/0366912 A1* 12/2017 Stein ..... H04S 7/304
2020/0021940 A1* 1/2020 Choueiri ..... H04R 3/005

FOREIGN PATENT DOCUMENTS

WO 2018/064528 A1 4/2018

OTHER PUBLICATIONS

Tylka, Joseph, and Edgar Choueiri. "Soundfield Navigation using an Array of Higher-Order Ambisonics Microphones." Audio Engineering Society, Sep. 30, 2016. (Year: 2016).*

(Continued)

*Primary Examiner* — James K Mooney
(74) *Attorney, Agent, or Firm* — SoCal IP Law Group LLP; Angelo J. Gaz

(57) ABSTRACT

A method of recording ambisonic sound fields with a spatially distributed plurality of ambisonic microphones comprising a step of recording sound signals from plurality of ambisonic microphones a step of converting recorded sound signals to ambisonic sound fields and a step of interpolation of the ambisonic sound fields according to the invention comprises a step of generating synchronizing signals for particular ambisonic microphones for synchronized recording of sound signals from plurality of ambisonic microphones and during the step of interpolation of the ambisonic sound fields it includes filtering sound signals from particular microphones with individual filters having a distance-dependent impulse response having a cut-off frequency $f_c(d_m)$ depending on distance $d_m$ between point of (Continued)

interpolation and m-th microphone applying gradual distance dependent attenuation applying re-balancing with amplification of $0^{th}$ ordered ambisonic component and attenuating remaining ambisonic components. Invention further concerns recording system and computer program product.

16 Claims, 4 Drawing Sheets

(56) References Cited

OTHER PUBLICATIONS

European Patent Office/ISA, International Search Report for PCT Application No. PCT/IB2020/050265, dated Apr. 15, 2020.
European Patent Office/ISA, Written Opinion for PCT Application No. PCT/IB2020/050265, dated Apr. 15, 2020.
Patricio Eduardo et al: "Toward Six Degrees of Freedom Audio Recording and Playback Using Multiple Ambisonics Sound Fields", AES Convention 146, Mar. 10, 2019, XP040706485.
Nils Peters (Qualcomm) et al: "On the application of multiple HOA streams for MPEG-I", 124. MPEG Meeting; Oct. 8, 2018-Oct. 12, 2018; Macao; (Motion Picture Expert Group or ISO/IEC JTC1/SC29/WG11), No. m44875 Oct. 4, 2018, XP030192449.
Eduardo Patricio (Zylia) et al: "Report on Recording of Test Material for 6DoF Audio", 125. MPEG Meeting; Jan. 14, 2019-Jan. 18, 2019; Marrakech; (Motion Picture Expert Group or ISO/IEC JTC1/ SC29/WG11), No. m46067 Jan. 9, 2019, XP030214555.
WIPO, Certified Priority Document for application No. PL428575, filed Jan. 14, 2019.

* cited by examiner

METHOD, SYSTEM AND COMPUTER PROGRAM PRODUCT FOR RECORDING AND INTERPOLATION OF AMBISONIC SOUND FIELDS

RELATED APPLICATION INFORMATION

This patent claims priority from International PCT Patent Application No. PCT/IB2020/050265, filed Jan. 14, 2020 entitled, "METHOD, SYSTEM AND COMPUTER PROGRAM PRODUCT FOR RECORDING AND INTERPOLATION OF AMBISONIC SOUND FIELDS", which claims priority to Poland Patent Application No. PL428575, filed Jan. 14, 2019 all of which are incorporated herein by reference in their entirety.

The invention concerns recording of ambisonic sound fields. More specifically the invention concerns interpolation of the ambisonic sound fields obtained from conversion of sound signals recorded with ambisonic microphones.

Sound field is the dispersion of sound energy within a space with given boundaries. Ambisonics is a sound format used for representation of the sound field taking into account its directional properties. In first order Ambisonics the sound field is decomposed into 4 ambisonic components—spherical harmonics. In higher order of Ambisonics (HOA) the number of ambisonic components is higher, thus the higher spatial resolution of the sound field decomposition can be achieved. Decoding of ambisonic sound field enables reproduction of the sound field at any point of the surrounding space represented by a sphere which originates from the point of recording.

Immersive media has had a significant increase in popularity and, as related technologies are developed, its usefulness has also seen growth with potential applications in entertainment, research, commerce and education. Six-degrees-of-freedom (6DoF) usually refers to the physical displacement of a rigid body in space. It combines 3 rotational (roll, pitch and yaw) and 3 translational (up-down, left-right and forward-back) movements. The term is also used to refer to the freedom of navigation in immersive/VR environments. While 6DoF has long been a standard in computer gaming, with widely available tools to implement both immersive audio and video, the same cannot be said about cinematic audio and video scenarios. Most VR audio content available nowadays presents a 3DoF (three-degrees-of-freedom) scenario, in which the user occupies a single, fixed point of view allowing rotation, but not translation movements. There have been noticeable advancements in volumetric videography, e.g. disclosed in US patent application no U.S. Ser. No. 10/349,194 and publication of international patent application no WO2003092260 which are relevant to VR/AR applications. On the other hand, there is still much to be done regarding live recorded 6DoF audio solutions.

According to Jot, J. et al. (2017) Group Report: A spatial audio format with 6 Degrees of freedom. The Twenty-Second Annual Interactive Audio Conference—Project Bar-B-Q, there is growing interest in 6DoF audio, but the solutions for live recorded scenarios are still very limited. Live recorded 6DoF audio can be particularly useful in scenarios in which it is of relevance to capture the acoustic characteristics of a specific space e.g. concert room or synchronized spatially spread sound sources (e.g. performing arts; sports events). It is possible to point to 2 main approaches to live recorded 6DoF audio rendering.

The first type of scenario makes use of a single ambisonic recordings with simulated off-center listening perspectives—such scenario discussed in detail e.g. in Tylka, J. G., & Choueiri, E. (2015, October), Comparison of techniques for binaural navigation of higher-order ambisonic soundfields, In Audio Engineering Society Convention 139, Audio Engineering Society, Schultz, F., & Spors, S. (2013, September), Data-based binaural synthesis including rotational and translatory head-movements, Audio Engineering Society Conference: 52nd International Conference: Sound Field Control-Engineering and Perception. Audio Engineering Society or Noisternig, M., Sontacchi, A., Musil, T., & Holdrich, R. (2003, June) A 3D ambisonic based binaural sound reproduction system. Audio Engineering Society Conference: 24th International Conference: Multichannel Audio, The New Reality. Audio Engineering Society.

The second type of scenario relies on simultaneous spatially adjacent recordings and was discussed by Plinge, A., Schlecht, S. J., Thiergart, O., Robotham, T., Rummukainen, O., & Habets, E. A. (2018, August), in Six-Degrees-of-Freedom Binaural Audio Reproduction of First-Order ambisonics with Distance Information, Audio Engineering Society Conference: 2018 AES International Conference on Audio for Virtual and Augmented Reality. Audio Engineering Society and by Tylka, J. G., & Choueiri, E. (2016, September), Soundfield Navigation using an Array of Higher-Order ambisonic Microphones, Audio Engineering Society Conference: 2016 AES International Conference on Audio for Virtual and Augmented Reality. Audio Engineering Society.

Tylka et al. disclosed a method and a system for recording ambisonic sound field with a spatially distributed plurality of higher order (HOA) ambisonic microphones. Sound signals are recorded with plurality of ambisonic microphones and afterwards converted to ambisonic filed. Values of the field in-between ambisonic microphones are interpolated. Ambisonic microphones are matrices of microphones for recording spatial audio. An example of such HOA microphone is disclosed in WO2017137921A1. The aim of interpolation is to reproduce 6DoF sound in the space between ambisonic microphones.

Plinge et al. disclosed 6DoF reproduction of recorded content based on spatially distributed positions and dedicated transformations for obtaining virtual signals at arbitrary positions of the listener.

In experimentation the inventors found that known methods of interpolation of ambisonic sound fields recording and conversion sound signals from ambisonic microphones to ambisonic sound field does not work as effectively as expected in general and particularly tend to fail in particular positions of virtual observer with respect to recording microphones.

A method of recording and interpolation ambisonic fields with a spatially distributed plurality of ambisonic microphones comprising a step of recording sound signals—so called A-format—from plurality of ambisonic microphones, a step of converting recorded sound signals to an ambisonic sound fields and a step of interpolation of the ambisonic fields. The method according to the invention is special during the step of recording it further comprises a step of generating synchronizing signals for particular ambisonic microphones for synchronized recording of sound signals from plurality of ambisonic microphones. That generation of individual signals allows synchronization precise enough to capture spatial properties of the ambisonic sound fields captured by the plurality of ambisonic microphones. During the step of interpolation of the ambisonic sound fields the method includes filtering sound signals from particular ambisonic microphones with individual filters having a distance-dependent impulse response having a cut-off frequency $f_c(d_m)$ depending on distance $d_m$ between point of interpolation (virtual listener's position) and m-th microphone, applying gradual distance dependent attenuation applying re-balancing with amplification of $0^{th}$ ordered ambisonic component and attenuating remaining components of order greater than 0. Application of distance dependent individual filtration and fading allows reducing disadvantageous impact of signals from ambisonic microphones being further away from the listener's position. Particularly attenuation of the ambisonic components of order greater than 0 allows elimination of irrelevant sound directivity information while preserving contribution of its energy. Amplification of the 0 order ambisonic component allows compensation of energy change and more natural perception of the sound.

Advantageously before step of recording plurality of ambisonic microphones is arranged in an equilateral triangular grid forming a diamond shape substantially planar or three dimensional. Use of planar grid is advantageous as the processing runs faster while (3D) distribution enables recording of the sound field in the in the volume of the room.

Advantageously cut-off frequency $f_c(d_m)$ decreases linearly with distance $d_m$ when $d_m$ exceeds predefined value.

Alternatively that cut-off frequency $f_c(d_m)$ decreases exponentially with distance $d_m$ when $d_m$ exceeds predefined value.

Advantageously attenuation of ambisonic components of order greater than zero increases exponentially with distance $d_m$ when $d_m$ exceeds predefined value $t_l$.

A system for recording and interpolation ambisonic sound field comprising a recording device and plurality of ambisonic microphones according to the invention has a means for generation of individual synchronization signals and recording device is adapted to execute a method according to the invention.

Advantageously plurality of ambisonic microphones is arranged in an equilateral triangular grid forming a diamond shape.

Advantageously equilateral triangular grid is substantially planar or alternatively it is distributed in three dimensions.

Means for generating synchronization signal are individual sound emitters located in proximity of particular ambisonic microphones.

Advantageously at least a subset of plurality of ambisonic microphones comprises identical ambisonic microphones and sound emitters are located on the ambisonic microphones within this subset in the same place.

Advantageously ambisonic microphones comprise microphone sensor capsules with individual analog-to-digital converters and means for generating synchronization signal comprise common generator of synchronization signals delivered to analog-to-digital converters of individual microphone sensor capsules.

Computer program product for recording and interpolation of ambisonic sound fields, which when executed on processing device fed with sound signals recorded from plurality of ambisonic microphones, is adapted to cause the processing device to execute conversion of the sound signals to ambisonic sound fields and interpolation of said ambisonic sound fields. The interpolation includes filtering ambisonic sound fields from particular microphones with individual filter having a distance-dependent impulse response having a cut-off frequency $f_c(d_m)$ depending on distance $d_m$ between point of interpolation and m-th microphone applying gradual distance dependent attenuation applying re-balancing with amplification of $0^{th}$ ordered ambisonic component and attenuating remaining ambisonic components of higher order.

Advantageously computer program product is adapted to cause processing device it is run on to detect sound synchronization signals in recorded signals from particular ambisonic microphones and synchronize sound recorded from particular ambisonic microphones prior to conversion and interpolation.

A system of recording ambisonic sound fields, according to the invention comprises a number of ambisonic microphones connected to processing unit adapted to generate synchronization signal and to receive recording results.

The invention has been described below in detail, with reference to the attached figures, wherein.

A method according to the invention requires signals from plurality of HOA microphones arranged in a grid covering area (flat) or volume (3D space).

Entire area or volume that is to be made navigable in the resulting recording needs to be covered by the grid. An uniform grid composed of equilateral triangles proved to be particularly effective. Experiments with square grids were also successful. In cases when full 6DoF with height is to be recorded, several layers of the grid may be stacked one above the other, possibly with an offset. Orientation of each HOA microphone in the grid should be the same, i.e. the "front" and "top" of all microphones should point to the same directions, respectively.

In present embodiment of the system according to the invention 9 HOA ambisonic microphones were used. ZYLIA ZM-1 spherical microphone array providing 19 channels from 19 microphone sensor capsules disclosed in WO2017137921A1 proved to be particularly well suited HOA microphone. 9 HOA microphones were used together with state of the art ZYLIA Ambisonics software A-B converter capable of producing ambisonics B-Format of up to the third order being run on processing unit.

RAW audio captured from the capsules of the ambisonic microphone are represented as multi-channel recording in the so-called A-format. Since each ambisonic microphone can have a different characteristics such as number of microphone sensor capsules, type of capsules and arrangement of the capsules, the A-format is specific to the amibsonic microphone model. The ambisonic sound field is represented in the B-format which is derived from A-format by means of convolution of the raw multi-channel signals with the dedicated matrix of impulse responses. The resulting B-format ambisonic sound fields are subjected to the user's distance dependent interpolation process. The A-B conversion in this example is performed as disclosed in Moreau, S., Daniel, J., & Bertet, S. (2006, May), 3D sound field recording with higher order ambisonics—Objective measurements and validation of a 4th order spherical microphone, in 120th Convention of the AES. Yet, other state of the art conversion mechanism are also applicable.

It has been found out that conversion of the recorded sound signals to ambisonic sound field requires precise synchronization. Ambisonic microphones provide mechanisms for synchronization of particular microphone sensors being a part of single ambisonic microphone but in order to perform an effective interpolation of the ambisonic sound fields a precise synchronization of sound fields from whole ambisonic microphones is also required.

Figure 5:
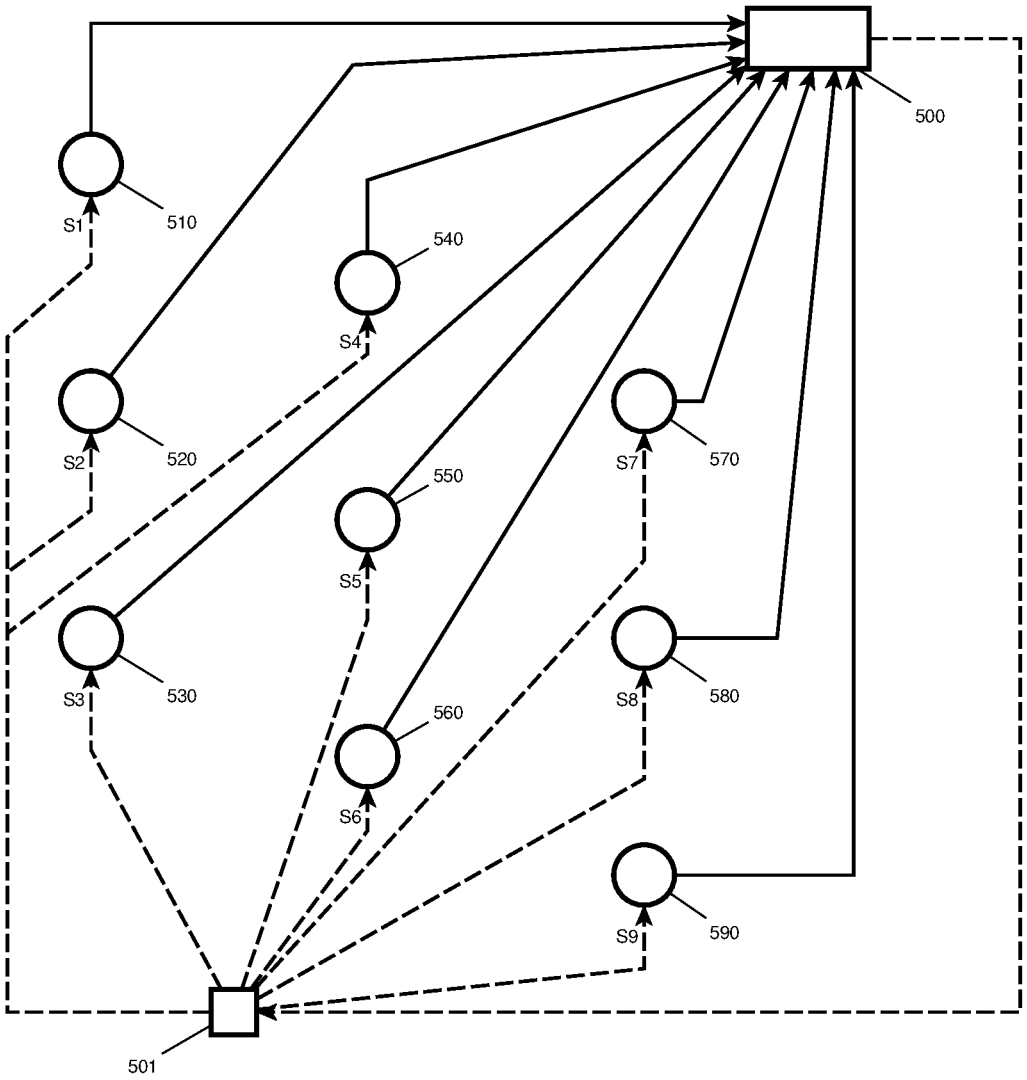
FIG. 5 shows a block diagram of an embodiment of the recording system according to the invention.

Block diagram of an embodiment of the system according to the invention is shown in FIG. 5. It comprises recording device 500 and a plurality of nine ambisonic microphones 510, 520, . . . 590 connected to the recording device and feeding sound signals to the recording device 500. Recording device generates individual sound signals with synchronization module 501. Synchronization signals are delivered to particular ambisonic microphones.

As the ZYLIA ZM-1 does not support an external synchronization through a word clock or USB input, a dedicated synchronization method was applied. The method is based on a hardware and a software components:

- piezoelectric buzzers as sound emitters. They were driven by a common synchronization signal delivered to them electronically. Buzzers were, attached at the base of each ZM-1 microphones in exactly same position near the same microphone sensor capsule;
- a software tool detecting a synchronization impulse played by the buzzers near the beginning and end of each recording and synchronizing/aligning recorded signals accordingly.

Such synchronization method allows the beginning of the recording from each HOA microphone to be time-aligned as well as the sample clock drift to be estimated. This operation allows for linear interpolation of audio samples.

Ambisonic microphones are identical and have a form of sphere with 19 microphone sensor capsule. Each of the ambisonic microphones has individual buzzer attached to the same point on the surface of sphere close to the same capsule. That allows most precise synchronization.

Each ambisonic microphone delivers 19 sound signals from individual capsules. The sound signals are converted to ambisonic sound fields. In the space between ambisonic microphones sound fields obtained from them are interpolated. Synchronization of the sound fields resulting from prior synchronization (alignment) of the sound signals proved to have strong effect on the quality of not only conversion but also interpolation.

Actual alignment of the recorded sound signals may either be done at the recording stage or at the stage of post-processing the signals and conversion.

Computer program product according to the invention when run on the processing device causes in post processing a conversion of sound signals to ambisonic sound fields and interpolation of the ambisonic sound fields in a manner presented below.

Computer program product may be further adapt to detect synchronization signals and cause alignment of signals or even adapted to be run on the recording device 500 and control the whole recording process.

Also alternative mechanisms for synchronization are available. Synchronization of the microphone arrays signals can be performed by application of the dedicated timecode audio signal. Time code signal is distributed as a single-channel audio signal which is attached as an additional audio channel to the raw multi-channel signals of the all microphone arrays used in the system.

Another way of synchronization is to feed a common World Clock signal to all of the Analog-to-Digital converters used for every single capsule of all of the microphone arrays in the system.

Method according to the invention provides a playback mechanism capable of ambisonic sound fields interpolation at locations of virtual observes between physical ambisonic microphones used during the recording stage. Computer program product according to the invention in some embodiments is run on the recording device and does synchronization, conversion and interpolation together with recording process while on others is used for post processing of previously recorded and synchronized signals. It can also receive raw signals—and incorporate software tool to detect synchronization audio signals form buzzers and synchronize in postprocessing.

Method according to the invention of ambisonic sound fields interpolation operates on time-domain ambisonic components which we denote $y_{m,p}(n)$, where m is the number of the HOA microphone, p is the ambisonic component index, and n is the sample index. The interpolated ambisonic component $x_p(n)$ is calculated as a sum of contributions from all HOA microphones in the recording grid. These contributions are calculated by a distance-dependent filtering and scaling of the original ambisonic components. Denoting the number of HOA microphones in the recording grid by M, the distance between the point of interpolation and the m-th microphone by $d_m$, the scaling function by $a_p(d_m)$, the filter by $h(d_m)$, and using the convention that (a*b)(n) is the convolution of signals a(n) and b(n), the interpolated signal can be expressed by:

$$x_p(n) = \sum_{m=1}^{M} a_p(d_m)(h(d_m) * y_{m,p})(n) \tag{1}$$

The distance-dependent $h(d_m)$ is a first-order low-pass infinite impulse response filter whose cut-off frequency $f_c$ is equal to 20 kHz when $d_m$ is below a threshold value $t_f$, and falls linearly with a slope $s_f<0$ when $d_m$ is above $t_f$:

$$f_c(d_m) = \begin{cases} 20\text{ kHz}, & \text{if } d_m \le t_f, \\ 20\text{ kHz} + s_f(d_m - t_f), & \text{if } d_m > t_f \end{cases} \tag{2}$$

Even better results may be obtained when applying exponential decrease of $f_c$ $(d_m)$ for $d_m$ exceeding $t_f$.

The scaling function $a_p(d_m)$ has two components $l(d_m)$ and $kp(d_m)$.

$l(d_m)$ applies a gradual fading of contributions from far-away ambisonic microphones corresponding to the free space attenuation—linear in dB scale.

Additionally, a re-balancing of the ratio between the $0^{th}$ order omni-directional ambisonics component (p=0) and the directional components (p>0) of higher orders is applied due to $kp(d_m)$ component.

Similarly to the filtering operation described above, the fading $l(d_m)$ and the component re-balancing $k_p(d_m)$ are progressively applied only when $d_m$ exceeds corresponding threshold values $t_l$ and $t_k$. Beyond these distances $l(d_m)$ and $k_p(d_m)$ change linearly (in dB): the greater the distance the stronger the attenuation and the greater the dominance of the omni-directional component over the directional ones. Mathematical formulation of the above follows:

$$a_p(d_m) = 10^{[l(d_m)+k_p(d_m)]/20} \quad (3)$$

$$l(d_m) = \begin{cases} 0, & \text{if } d_m \le t_l, \\ s_l(d_m - t_l), & \text{if } d_m > t_l \end{cases} \quad (4)$$

$$k_p(d_m) = \begin{cases} 0, & \text{if } d_m \le t_k, \\ s_{k,p}(d_m - t_k), & \text{if } d_m > t_k \end{cases} \quad (5)$$

Distance-dependent attenuation and ambisonics order re-balancing are formulated nearly identically cf. (4) and (5). However, the attenuation slopes for ambisonics component re-balancing can be different for each ambisonics component index p. Typically, this slope will be positive for the zeroth-order ambisonic component and negative for higher-order ambisonic components:

$$s_{k,p=0}>0,\ s_{k,p>0}<0 \quad (6)$$

Consequently the contributions from far-away HOA microphones are not only attenuated but also less contribute to the direction of arrival of the interpolated signal due to attenuation of the higher order ambisonic component.

Attenuation of higher order ambisonic components results in change of total energy, which if not compensated would be detectable by human as unnatural sound level decrease. That change is compensated by increase of 0-order ambisonic component because of $s_{k,p=0}>0$.

While more advanced methods based on physical modeling of the sound field have been proposed in the past by Plinge et al. and Tylka et al. The relative simplicity of the method according to the invention allows a real-time interactive system to be implemented and used on a personal computer.

An interactive system was developed to test the method according to the invention interpolation method of simultaneous adjacent ambisonic recordings. Its final design choices, regarding functionality and parameter control, were based on the general theoretical proposition and the need to perform interactive subjective evaluations. The system has two main components: an input/control application, a representational navigable 3D environment and application that executes all the necessary audio transformations based on the navigation input data, having interface shown in FIG. 2.

The positioning data sent from the navigable 3D scene to the playback component is used to calculate the distance between the listener's position and the center of each sound field. This distance is the main reference value to control the interpolation mechanism. So, for any given sound field, as the listener moves farther from the center, the following sound transformations occur: (a) volume level fades out; (b) a low-pass filter is applied, and (c) the ambisonic image is gradually reduced to $0^{th}$ order. It is possible to set a distance threshold (a point at which the transformation starts) and range that determines the distance necessary to go from 0 to 100% applied transformation. For volume, the full range of transformation goes from the original volume to −75.6 dB; for low-pass filtering the cut-off frequency is gradually shifted from 20 kHz (no filtering) to 200 Hz with 6 dB attenuation per octave; for the ambisonic order transformation, crossfading is done between the original order (1st or 3rd) and the 0th order. Both threshold and range parameters are given in meters. The flexibility of defining thresholds and ranges for each transformation, consistently, across all sound fields, is meant to provide room for experimentation and different interpolation configurations.

The system considers a specific microphone arrangement as seen on the central area of the application's user interface (Fig.). The distance between microphones, a, in meters, can be set in the program to match the distance used during recording. This parameter is essential to calculate the position of each microphone in the grid and, consequently, perform the necessary distance-based interpolations.

The output of the interpolated ambisonics sound fields is sent to a binaural decoder and can be listened to on headphones. The standard ambisonics rotation transformations are done by IEM's 'Scene Rotator' VST plug-in.

The playback system is capable of 5-degrees-of-freedom playback. Vertical translation movement (up and down) is not included and it could be implemented in a future iteration for playback of recording grids with microphone arrays placed in different elevations.

Spatial attributes of a recorded acoustic scene are preserved when using the proposed strategy for interpolation of multiple ambisonics sound fields. The following aspects were of particular interest:

- naturalness and realism of the perceived direction and distance of sound sources,
- naturalness and smoothness of auditory image evolution when moving across the scene.

To this end a modified MUSHRA 0 methodology (as disclosed in International Telecommunication Union, "ITU-R BS.1534-3, Method for the subjective assessment of intermediate quality level of audio systems," 2015) was adopted with audio-visual stimuli presented by means of a computer screen and stereo headphones. This allowed the test subjects to have a visual reference regarding the true placement of sound sources in the scene.

Audio component of the stimuli was prepared as follows. An acoustic scene comprising three sound sources was recorded in a room measuring 4.5×6.5×2.8 m and exhibiting an average reverberation time of 0.26 s. The sources were chosen to have different tonal and temporal characteristics. The first source was a floor-standing fan that was switched on throughout the recording session. Strips of foil were attached to it in order to make the airflow more audible. Two 5-inches loudspeakers were used as the second and third sources. A sound of a phone ringing intermittently was played through one the loudspeakers and a cartoon soundtrack through the other one. The three sources were arranged in a triangle around the center of the room, 2.5 to 3.5 meters from one another.

The above-mentioned sources were recorded by a system made up of 9 ZYLIA ZM-1 HOA microphones arranged in an equilateral triangular grid forming a diamond shape encompassing substantially the entire room.

The distance between adjacent microphones in the grid was 1.6 m and the height of all the microphones above the floor was 1.7 m. Since the HOA microphone grid was two-dimensional (without height), the resulting recording did not contain full 6DoF information. This was deemed sufficient for the purpose of this evaluation. In addition to the HOA microphones, three large-diaphragm condenser microphones were used to record each of the sources from a short distance. Directional characteristic of these microphones was set to cardioid which resulted in a high degree of separation between the recorded sources.

The signals registered by the HOA microphones were time-aligned using the system described in Section 2 and subsequently transformed to the Ambisonic domain using the A-B converter. The ambisonics-encoded signals were processed by the proposed interpolation method and subsequently binauralized by IEM rotator and binaural decoder plugins within the Max MSP described in section 3.

Since the recording took place in a relatively small room, the low-pass filtering functionality of the proposed method was not used. The remaining parameters of the interpolator were set as follows:

$$t_l = t_k = 1.4\text{m},\ s_l = -38\ \text{dB/m},$$

$$s_{k,p=0} = 10\ \text{dB/m},\ s_{k,p>0} = -126\ \text{dB/m}$$

Three different renderings of the ambisonics sound fields were prepared as stimuli for the test:

- The $0^{th}$ order ambisonics (0OA) interpolated by cross-fading according to listener position. This was included as the hidden anchor in the test.
- The $1^{st}$ order ambisonics (1OA) interpolated by using the proposed method.
- The $3^{rd}$ order ambisonics (3OA) interpolated by using the proposed method.
- The 0OA signal contained no spatial clues apart from loudness changes according to distance from a given source.

The fourth stimulus condition was prepared by spatializing signals of the cardioid microphones at the original positions of the sound sources in the room using Google Resonance decoder and room reverberation simulator (ResonanceAudioRoom Unity audio component). This stimulus was used as the reference in the MUSHRA test.

Other tests and recording shown good results of the method according to the invention for $$t_l \in (0.3\ \text{m},\ 2\ \text{m})$$

$$t_k \in (0.3\ \text{m},\ 2\ \text{m})$$

$$s_l \in \left(-20\frac{\text{dB}}{\text{m}},\ -\frac{60\ \text{dB}}{\text{m}}\right),$$

$$s_{k,p=0} \in \left(3\frac{\text{dB}}{\text{m}},\ \frac{20\ \text{dB}}{\text{m}}\right),$$

$$s_{k,p>0} \in \left(-40\frac{\text{dB}}{\text{m}},\ -140\frac{\text{dB}}{\text{m}}\right)$$

Figure 1:
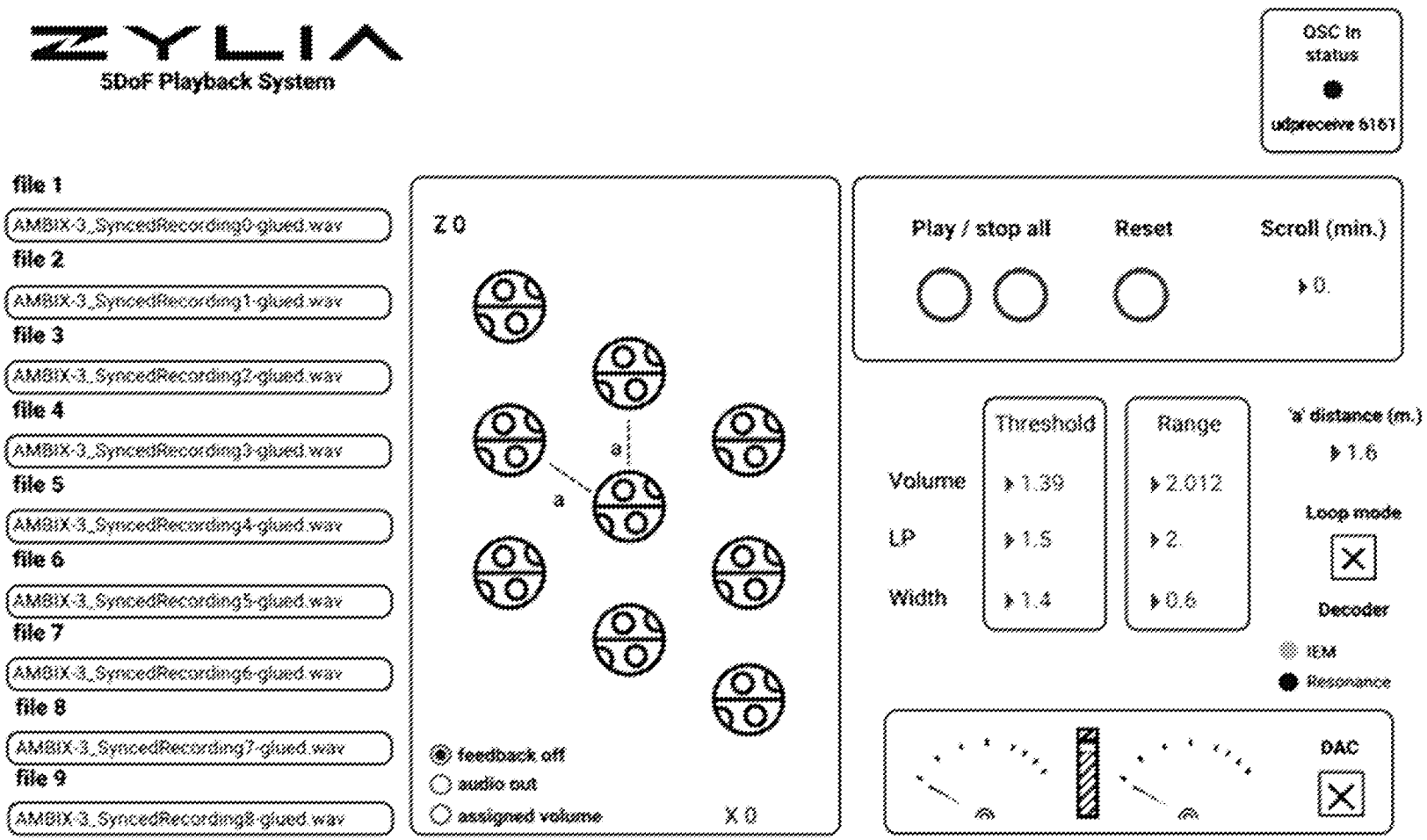
FIG. 1 shows exemplary playback program user interface.
Figure 2:
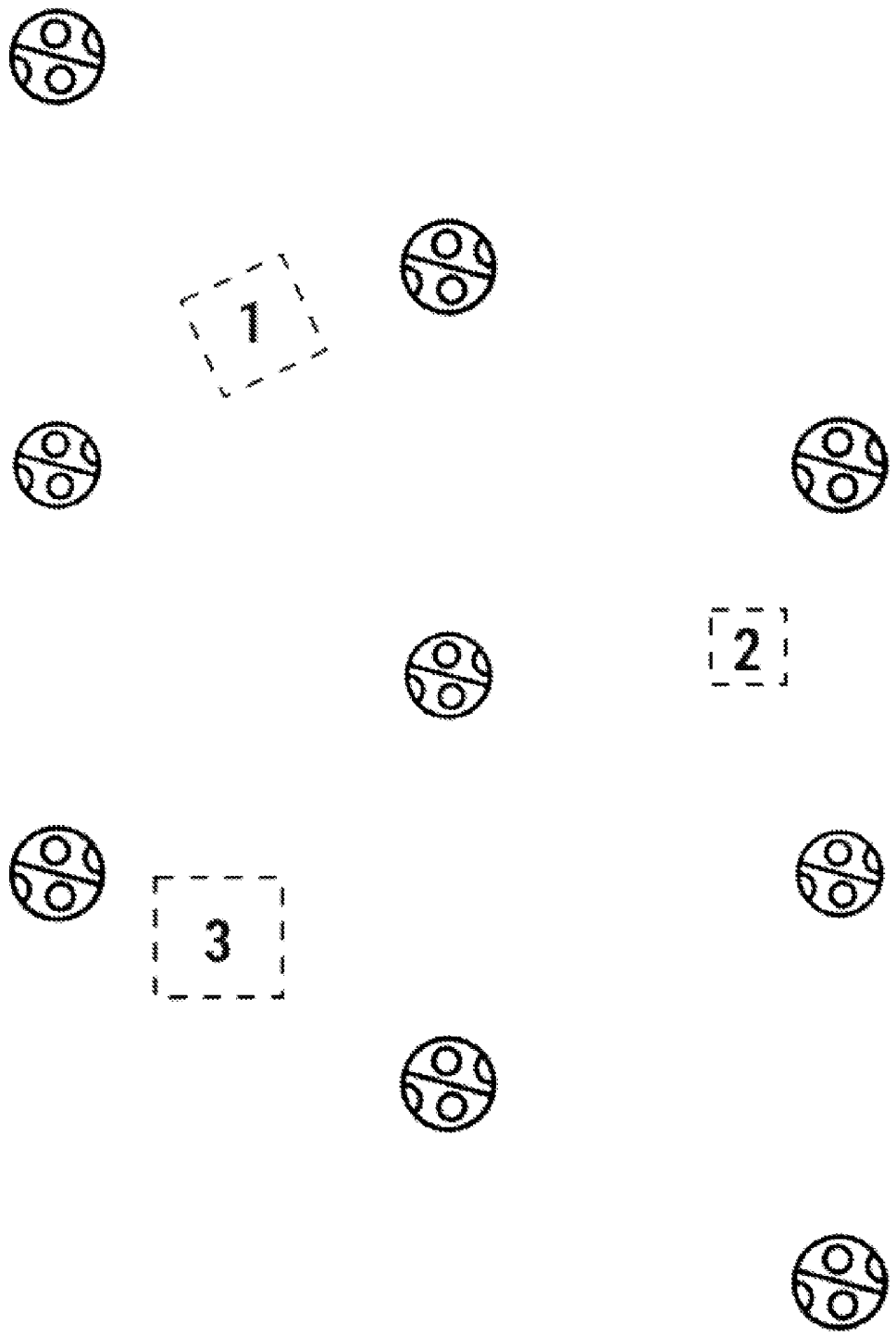
FIG. 2 shows top view of the virtual room with sound sources and microphone placement indications: (1) TV set, (2) phone and (3) fan.

The visual component of the stimuli was prepared in Unity 3D engine and consisted of an interactively navigable virtual recreation of the room where the sound signals were recorded. The fan and the phone were represented by 3D objects of a fan and a phone, respectively. At the position of the third source playing a cartoon soundtrack, a TV receiver object was placed. The dimensions of the room and positions of the sources within it corresponded to the physical room dimensions and source positions. A top view of the virtual room is shown in FIG. 2.

The virtual camera was controllable by means of a keyboard and mouse in a way similar to computer games with first person perspective.

Rendering of the audio component of the stimuli was synchronized with the 3D visual scene by linking the Unity 3D session with the Max MSP implementation of the proposed interpolation method via OSC messages. This allowed synchronization of the position and orientation of the virtual listener in the audio scene to the position and orientation of the virtual camera in the 3D visual scene. This system allowed for interactive audio-visual exploration of the virtual room in 5DoF. However, in order to better control the evaluation experiment, a pre-rendered video of the room was prepared where the virtual viewer and listener move on a predefined path around the room. The movement trajectory in the pre-rendered video included two translation dimensions (front-back and left-right) and one rotation dimension (pitch). By removing the interactive aspect during the MUSHRA test and using a pre-rendered cinematic one instead, we were able to ensure that all participants of the experiment experience the same stimuli. The visual component of the stimulus was rendered once and was used for all four audio stimuli described above.

Presentation system consisted of a personal computer with a player application enabling gapless playback switching between the various audio stimuli included in the test while at the same time displaying the visual component which was common between all conditions. The test interface was presented to test subjects on a separate computer from the one used for stimuli presentation. Two questions were asked:

- Test 1: In a scale from 0 to 100 how natural and realistic is the acoustic localization of sound sources with respect to their position in the video?
- Test 2: In a scale from 0 to 100 how natural and smooth is the evolution of distance and position of sound objects during changing the listening point in the scene (translation and rotation)?

Additionally, participants were asked to write notes regarding the general listening impression.

The listening tests were done with 15 trained subjects with the average age of 29.5 years (with standard deviation of 5.1). 4 subjects were female. 12 subjects had an experience in MUSHRA listening tests before. Most of the subjects were familiar with the acoustics of the room in which the test item was recorded. All of the subjects scored the Reference system over 90 in both tests, however 2 of them scored the 1OA-based systems lower than the Anchor. Therefore, the scores of those subjects were removed from statistical analysis of the results.

Figure 3:
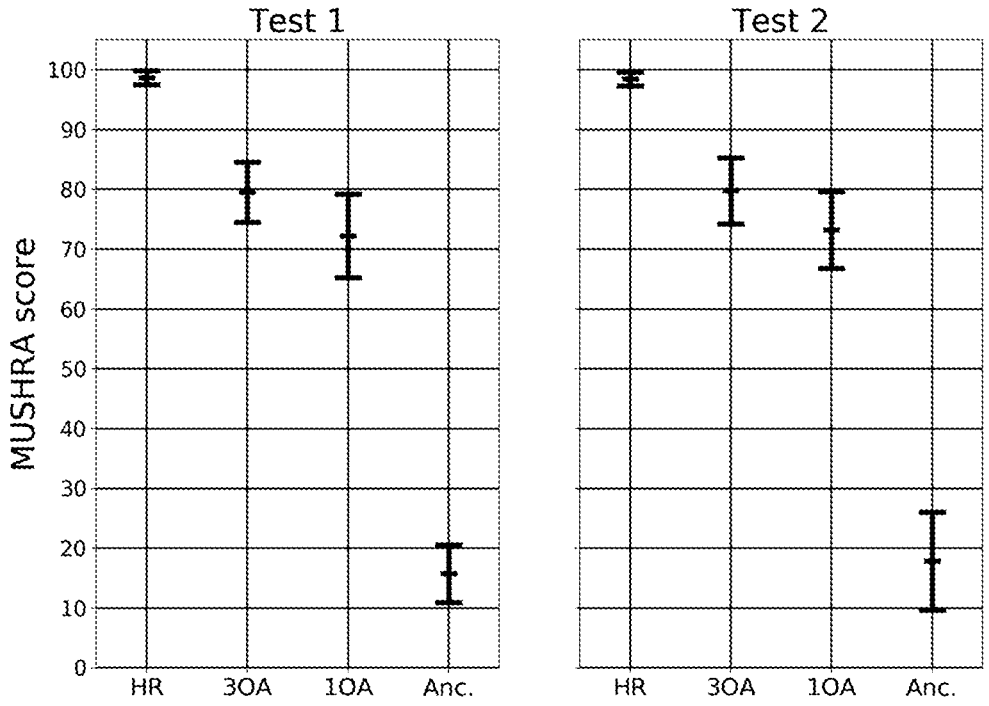
FIG. 3 shows absolute MUSHRA scores for Test 1 and Test 2. The 95% confidence intervals (13 listeners) are plotted.
Figure 4:
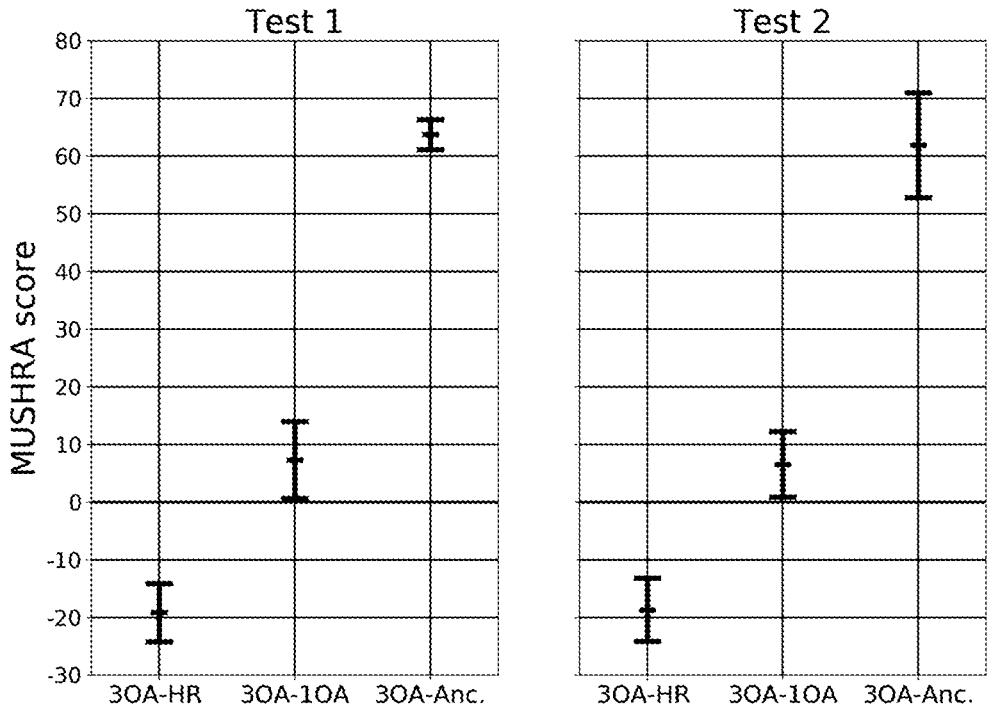
FIG. 4 shows differential MUSHRA scores (3OA vs other conditions) for Test 1 and Test 2. The 95% confidence intervals.

FIG. 3 shows the absolute scores with 95% confidence intervals for Test 1 and Test 2. For both tests the Reference system performed significantly better than other assessed systems. Still, the performance of 3OA-based systems was rated as "Excellent" in the MUSHRA scale, with average scores of 79.5 for Test 1 and 79.8 for Test 2. The confidence intervals of 1OA- and 3OA-based systems are overlapping by 4-5 MUSHRA points. However, in the differential scores (FIG. 4) it can be noticed that for both Tests 3OA-based system performed better than the 1OA-based one, showing statistically significant improvement.

It is noteworthy that, despite the scores of Test 1 and Test 2 of individual subjects varied significantly, the averaged scores of these Tests show high level of correlation.

As the results of MUSHRA evaluation show, the proposed method can be a viable to interpolate simultaneous adjacent ambisonics recordings, providing a decent level of consistency in terms of sound source localization and perception of the translation movement within the recorded audio scene. During the test subjects also reported that:

- 3OA-based system had more convincing ambient sound than the Reference and 1OA-based systems.
- 1OA- and 3OA-based systems sound more realistic in terms of recreation of the room acoustic properties.
- 3OA-based system provides a better sense of localization and immersion of the sound over the 1OA-based system.
- Acoustic localization of the sound sources in the Reference signal is more obvious but it sounds artificially.

The system and method according to the invention are highly applicable for virtual reality purposes. Computer program product according to the invention in some embodiments may be fed with signals already synchronized at the recording step or detect synchronization signals and execute channel synchronization prior to conversion of the sound signals to the ambisonic sound field.

It is stressed that description above illustrate rather than limit the invention, and that those skilled in the art will be able to easily provide many alternative embodiments and recording scenarios.

The computer program product according to the invention may be provided on a tangible or non-tangible data carrier including memory devices and data connections. Variants of the computer program product may be used directly in recording process or in postprocessing of previously recorded signals.

The invention claimed is:

1. A method of recording and interpolation of ambisonic sound field with a spatially distributed plurality of ambisonic microphones comprising a step of recording sound signals from the plurality of ambisonic microphones, a step of converting recorded sound signals to an ambisonic sound fields, and a step of interpolation of the ambisonic sound fields, the step of recording further comprises a step of generating synchronizing signals for particular ambisonic microphones of the plurality of ambisonic microphones for synchronized recording of sound signals from the plurality of ambisonic microphones and the step of interpolation of the ambisonic sound fields includes:

filtering ambisonic fields from the particular microphones with an individual filter having a distance-dependent impulse response having a cut-off frequency $f_c(d_m)$ depending on distance $d_m$ between a point of interpolation and an m-th microphone of a recording grid having m higher order ambisonic (HOA) microphones, applying distance dependent attenuation, and applying re-balancing with amplification of $0^{th}$ ordered ambisonic component and attenuating remaining ambisonic components of order greater than 0.

2. The method according to claim 1, characterized in that before the step of recording the plurality of ambisonic microphones is arranged in an equilateral triangular grid forming a diamond shape.

3. The method according to claim 2, characterized in that the equilateral triangular grid is planar.

4. The method according to claim 2, characterized in that the equilateral triangular grid is distributed in three dimensions.

5. The method according to any of claim 1, characterized in that the cut-off frequency $f_c(d_m)$ decreases linearly with distance $d_m$ when $d_m$ exceeds a predefined value.

6. The method according to any of claim 1, characterized in that the cut-off frequency $f_c(d_m)$ decreases exponentially with distance $d_m$ when $d_m$ exceeds a predefined value.

7. The method according to any of claim 1, characterized in that the attenuation of ambisonic components of order greater than zero increases exponentially with distance $d_m$ when $d_m$ exceeds a predefined value $t_l$.

8. A system for recording and interpolation of ambisonic sound field comprising a recording device and the plurality of ambisonic microphones the system comprising a means for generation of individual synchronization signals and the recording device being adapted to execute a method as defined in claim 1.

9. The system according to claim 8, characterized in that the plurality of ambisonic microphones is arranged in an equilateral triangular grid forming a diamond shape.

10. The system according to claim 9, characterized in that the equilateral triangular grid is planar.

11. The system according to claim 9, characterized in that the equilateral triangular grid is distributed in three dimensions.

12. The system according to claim 8, characterized in that the means for generation of individual synchronization signals are individual sound emitters located on the particular ambisonic microphones.

13. The system according to claim 12, characterized in that at least a subset of the plurality of ambisonic microphones comprises identical ambisonic microphones and the individual sound emitters are located on the at least subset of the plurality of ambisonic microphones in the same position near a microphone sensor capsule.

14. The system according to claim 8, characterized in that the plurality of ambisonic microphones comprise microphone sensor capsules with individual analog-to-digital converters and the means for generating synchronization signals comprise common generator of synchronization signals delivered to the analog-to-digital converters of individual microphone sensor capsules.

15. A computer program product stored in a non-transitory computer readable medium and for recording and interpolation of ambisonic sound fields, which when executed on a processing device fed with sound signals recorded from a plurality of ambisonic microphones, is adapted to cause the processing device to execute conversion of the sound signals to ambisonic sound fields and interpolation of said ambisonic sound fields, characterized in that the interpolation includes:

filtering the ambisonic sound fields from particular microphones of the plurality of ambisonic microphones with an individual filter having a distance-dependent impulse response having a cut-off frequency $f_c(d_m)$ depending on distance $d_m$ between given a point of interpolation and an m-th microphone of a recording grid having m higher order ambisonic (HOA) microphones, applying distance dependent attenuation, and applying re-balancing with amplification of $0^{th}$ ordered ambisonic component and attenuating remaining ambisonic components.

16. The computer program product according to claim 15, characterized in that the product, when executed is adapted to cause the processing device to generate sound synchronization signals in recorded signals from the particular ambisonic microphones and synchronize sound recorded from the particular ambisonic microphones prior to conversion and interpolation.

* * * * *